United States Patent [19]

Quasarano

[11] 4,260,072

[45] Apr. 7, 1981

[54] SHIPPING, TRANSPORTING AND DISPENSING CONTAINER FOR CYLINDRICALLY SHAPED OBJECTS

[76] Inventor: Joseph R. Quasarano, 620 South Oxford, Grosse Pointe Woods, Mich. 48236

[21] Appl. No.: 124,704

[22] Filed: Feb. 26, 1980

Related U.S. Application Data

[63] Continuation of Ser. No. 878,820, Feb. 17, 1978, abandoned.

[51] Int. Cl.[3] ..... A47F 1/00

[52] U.S. Cl. ..... 221/92; 221/229; 312/45; 211/49 D

[58] Field of Search ..... 221/92, 131, 191, 193, 221/194, 281, 289, 251, 311; 312/42, 45, 72, 350; 211/49 D, 49 R; 414/621

[56] References Cited

U.S. PATENT DOCUMENTS

| | | | |
|---|---|---|---|
| 2,956,660 | 10/1960 | Nordquist | 221/193 |
| 3,194,431 | 7/1965 | Garvin | 221/251 X |
| 3,294,306 | 12/1966 | Areddy | 414/621 |
| 3,318,455 | 5/1967 | Takahashi | 211/49 D |

*Primary Examiner*—Joseph J. Rolla

*Attorney, Agent, or Firm*—Remy J. VanOphem

[57] ABSTRACT

A shipping, transporting and dispensing container for cylindrically shaped objects has a base, back wall, two side walls and is open at the front and top. A plurality of platform shelves are succeedingly spaced above the base of the rack. Each shelf is sloped downwardly from the open front of the rack toward the back wall of the rack but terminates short of the back wall by a predetermined distance. An adjustable stop device is situated in the space between the base and the shelf immediately above it to selectively prevent cylindrically shaped objects disposed near the back wall on the base from rolling toward the open front of the container. Further, the front edge of the base at the open front of the container has an upwardly projecting flange which prevents the cylindrically shaped objects, supported on the base, from inadvertently rolling off the base through the open front of the container.

15 Claims, 6 Drawing Figures

SHIPPING, TRANSPORTING AND DISPENSING CONTAINER FOR CYLINDRICALLY SHAPED OBJECTS

This is a continuation of application Ser. No. 878,820, filed Feb. 17, 1978 now abandoned.

BACKGROUND OF THE INVENTION

1. Field of the Invention

The present invention relates to containers for special articles, and more particularly to a container for shipping, transporting and dispensing heavy cylindrically shaped objects, such as beer barrels.

2. Description of the Prior Art

For many years, beer barrels were delivered by providing a means to roll the barrel upon a flat bed truck such that they could be stacked in a single layer and transported. Upon reaching the destination, it was again rolled off the truck and delivered to the purchaser.

More recently, however, in order to reduce the delivery cost, beer barrels are palletized for transportation purposes. They are received on pallets at the wholesaler and transported from the wholesaler's warehouse by use of a delivery truck which may have as many as 80 palletized barrels in three-high stacks. Generally, each pallet contains four one-half barrels of beer. A hydraulic lift is used to load the palletized barrels onto a delivery vehicle. The truck itself is provided with a bumper pad which is used to unload the barrels at their final destination.

The bumper pad is generally rubber, although, there are some rope pads used today. When the barrel beer reaches its final destination, a driver or his helper must unload the barrels by reaching up to the top layer of the loaded palletized barrels and tip over a barrel so that it falls onto the rubber pad of the vehicle. Often times, due to lack of experience, loss of grip or lack of space, the barrel, as it is dropped, misses the rubber pad and hits either the truck or the ground in the vicinity of the truck. This often results in damage to the truck as well as damage to the barrel itself. Basically, the most accepted way of unloading the barrel is to clear the area and drop them onto the rubber pad of the vehicle. Naturally, after the first layer of palletized beer barrels are unloaded, the procedure of unloading the truck is somewhat easier in that due to the availability of space, the driver or helper handling the barrels has more room to direct the barrel onto the rubber or rope pad that is a part of the truck.

Naturally, it is readily understood that the method of handling these barrels is not only dangerous to the driver and helper but also results in a higher cost of delivery since the damaged aluminum barrels must be repaired and in cases where stainless steel barrels are used, generally, these are not repairable. Also, regardless of the method of dispensing the barrels from the truck, two men are required in order to control the removal of the barrels from the vehicle to a manageable position on the floor. It is easily understood that the method used for unloading the truck does not provide for easy, efficient, safe and rapid dispensing of the individual barrels from the pallets.

SUMMARY OF THE INVENTION

The present invention recognizes the drawbacks of these known methods of shipping and transporting beer barrels and provides a shipping, transporting and dispensing rack which obviates these drawbacks.

More particularly, the present invention provides a shipping, transporting and dispensing container for cylindrically shaped objects, such as beer barrels, which has a three-sided wall structure, and a base structure for supporting cylindrically shaped objects laid on their side to rest on the cylindrical side. The front and top of the container are open for access to the cylindrically shaped objects for either loading or unloading the container. At least one, but preferably two shelf structures for supporting cylindrically shaped objects, laid on their side, are spaced above the floor structure and succeedingly, one above the other. Each of these platform or shelf structures slopes downwardly from the open front of the container toward the back wall structure. The platform shelf terminates short of the back wall structure in order to provide an opening for the cylindrical object to pass through when laid on its side. Thus, cylindrically shaped objects can be placed upon the platform structure and as a result of their own gravitational force, will roll toward the back wall, pass through the opening between the platform shelf and the back wall and advance to the base of the container. The base of the container has an upwardly projecting flange attached at its front end at the open side of the container to prevent the cylindrical objects from inadvertently rolling off the base structure through the open front of the rack. Further, the container also has a releasable stop device for selectively preventing movement of the cylindrically shaped objects along the base structure from a position adjacent the back wall structure toward the open front of the rack.

It is a primary object of this invention to provide a container for cylindrically shaped objects which can be used for storing, transporting and dispensing beer barrels.

It is a further object of this invention to provide a container which can be lifted by a hydraulic truck and placed on a delivery vehicle.

It is still a further object of this invention to provide a container from which cylindrically shaped objects can be dispensed safely by one person thereby reducing the cost of delivery for these objects.

It is still a further object of this invention to provide a container which is lightweight, safe and efficient and further requires the use of only one person to dispense the cylindrically shaped objects from the container.

This above and other objects and features of the invention will become apparent from the following detailed description taken in conjunction with the accompanying drawings and claims which form a part of the specification. Further, use of reference characters is for the purpose of clarification and is not intended to limit the specific embodiments referenced.

DETAILED DESCRIPTION OF THE PREFERRED EMBODIMENT

The figures illustrate the preferred embodiment of a container for shipping, transporting and dispensing cylindrically shaped objects, such as beer barrels illustrated in phantom lines.

Figure 1:
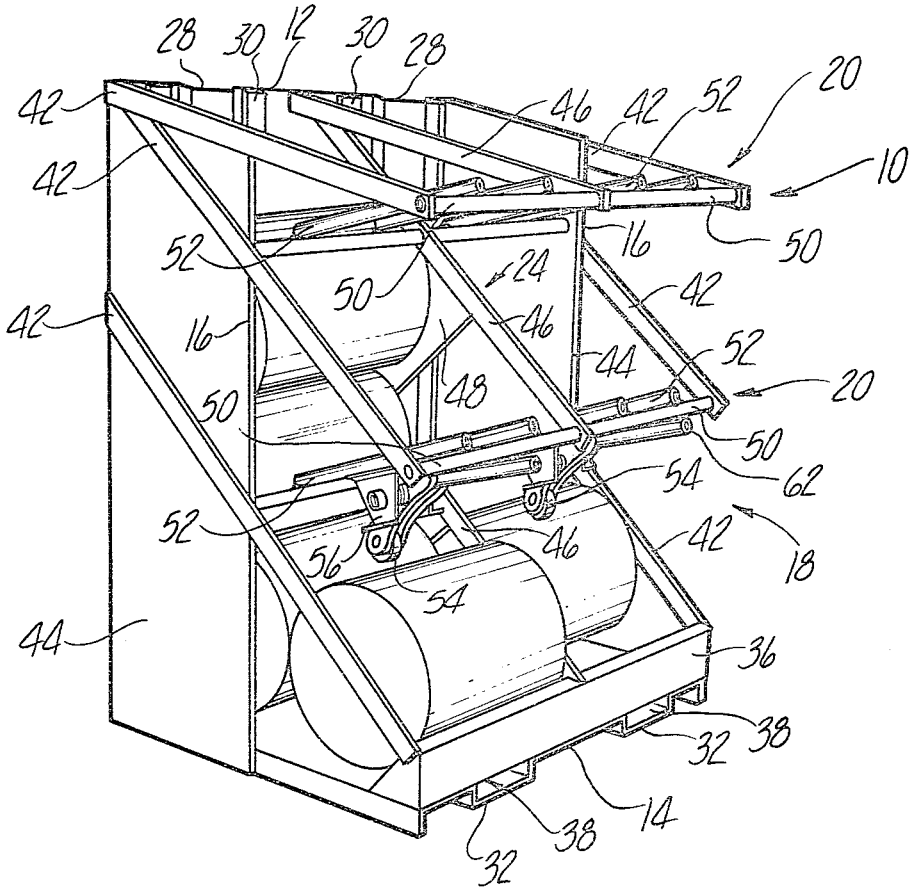
FIG. 1 is a perspective view of the container embodying the principles of the invention.
Figure 2:
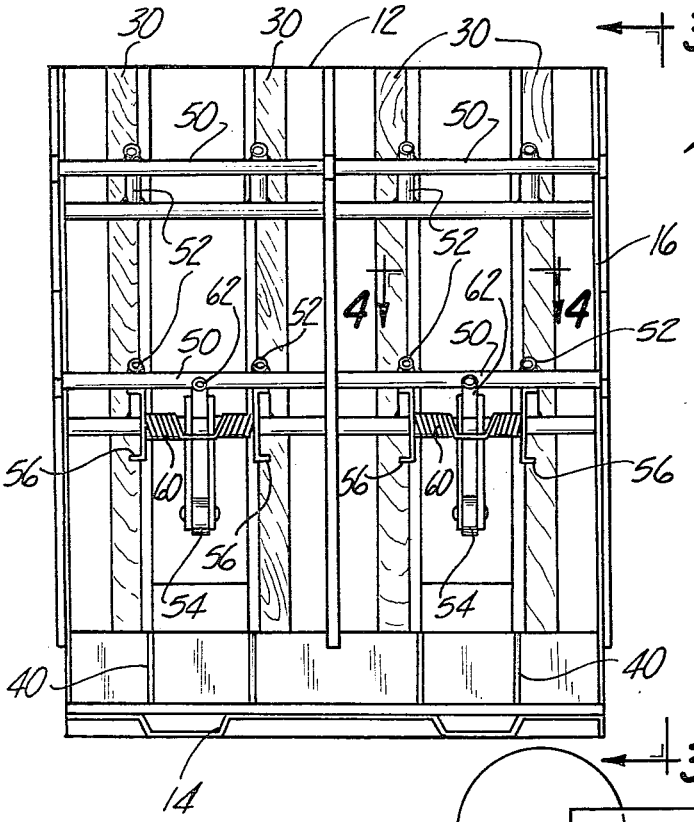
FIG. 2 is a front view of the container embodying the principles of the invention.
Figure 3:
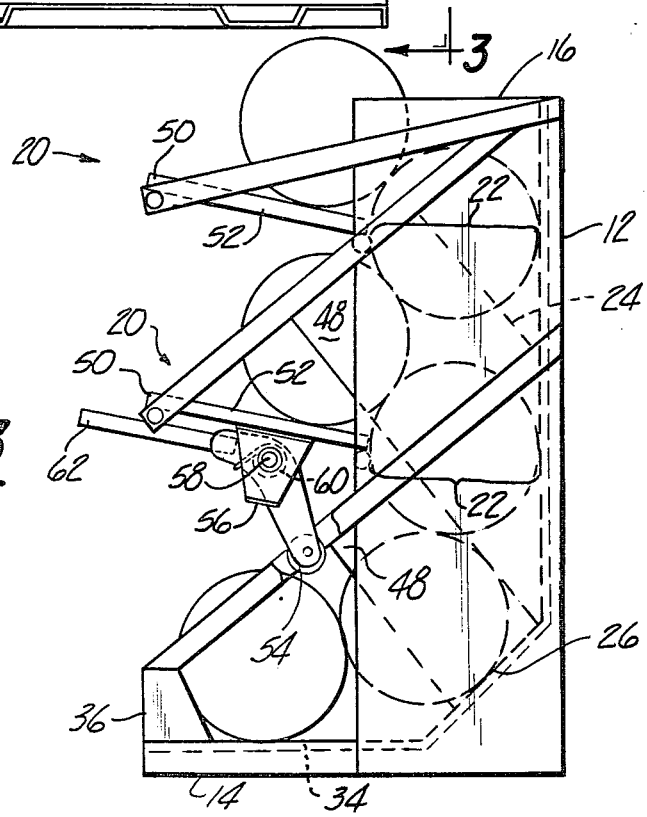
FIG. 3 is a view along lines 3—3 of FIG. 2 with a full compliment of cylindrically shaped objects loaded on the container.

Referring to FIGS. 1-3, the container 10 comprises an upright frame structure 12, a base structure 14 for supporting the beer barrels laid on their side to rest on their cylindrical wall, and two spaced-apart side wall structures 16 with the front of the rack being open, as indicated generally as the number 18, for access to the barrels in the rack 10. Further, two platform shelf structures 20, for supporting barrels laid on their side to rest on their cylindrical wall, are spaced above the base structure 14 and succeedingly one above the other. Each platform structure 20 slopes from the open front 18 of the rack 10 towards the upright frame structure 12, but terminates short of the frame structure 12 by a distance, generally denoted as the numeral 22 (shown in FIG. 3), which is somewhat greater than the diameter of the beer barrels. An intermediate wall structure 24 is disposed between and parallel to the side wall structures 16 and is spaced from each side wall structure 16 by a distance somewhat greater than the axial length of the barrels. A guide ramp structure 26 extends from the frame structure 12 to the base structure 14 below the space defined between the terminal edge of the shelf structure 22 and back wall structure 12.

Figure 4:
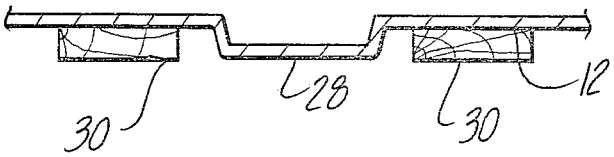
FIG. 4 is a section view along lines 4—4 of FIG. 2.

The frame structure 12 is formed of a rigid strong sheet material, such as aluminum, and may be ribbed, (a cross section is shown in FIG. 4) as at the numerals 28, for added rigidity. In addition, rub strips 30, such as lengths of wood or rubber, may be attached vertically to the back wall structure to prevent damage to the barrels.

The base structure 14 is also formed of a rigid, strong sheet of material such as aluminum, and may be ribbed, as at the numeral 32 for added rigidity. In addition, rub strips 30, such as lengths of wood or rubber may be attached to the base structure. The base structure 14 also has an upwardly projecting flange structure or stop 36 attached along its front edge at the open front 18 of the rack to prevent barrels supported on the base structure from inadvertently rolling off through the open front 18. The flange structure 36 is illustrated as being an elongated member with a generally U-shaped transverse cross-section. This flange structure is preferably fabricated of metal and may be attached to the base structure by any convenient or otherwise conventional means such as, for example, welding or bolts. The base structure 14 is also provided with means such as, for example, channels 38 for receiving the forks of a fork lift truck (not shown). These channels may be formed of separate components attached to the base structure or, as illustrated, be defined by the ribs 32 in the base structure itself. The frame 12 and base structure 14 may be attached together vertically by any convenient or conventional means such as, for example, welding or bolts.

The guide ramp structure 26 is also preferably made of rigid, strong sheet material, such as aluminum, and may be ribbed, as at the numerals 40, for added rigidity. The ramp structure can be attached to the frame structure 12 and base structure 14 by virtually any convenient or conventional means such as, for example, welding or bolts.

Each side wall structure 16 is comprised of a structural network of beam members 42 attached to the frame structure 12 at one of their ends and extending from the frame structure toward the open front 18 of the container. These beam members 42 are preferably fabricated of aluminum and are attached to the frame structure 12 by any convenient or conventional means such as, for example, welding or bolts. Further, each side wall structure 16 comprises a panel 44 disposed adjacent the frame structure 12 and, at least partially, covering the open areas defined by the network of beam members 42. The panels 44 can be fabricated of, for example, aluminum and be attached to the beam members 42 and the frame structure 12 by, for example, welding or bolts.

Likewise, the intermediate wall structure 24 is also comprised of a structural network of beam members 46 attached to the frame structure 12 at one of their ends and extending from the frame structure toward the open front 18 of the container. These beam members 46 are preferably fabricated of aluminum and are attached to the frame structure 12 by any convenient or conventional means such as, for example, welding or bolts. Further, the intermediate wall structure 24 comprises at least one, or as illustrated, two panels 48 each disposed adjacent the back wall structure 12 and, at least partially, covering the open areas defined by the network of beams 46. The panels 48 can be fabricated of, for example, sheet metal and be attached to the beam members 46 and the back wall structure 12 by, for example, welding or bolts.

Each shelf structure 20 comprises a plurality of parallel spaced-apart first rod members 50 longitudinally extending between the side wall structures 16 and attached thereto, and a plurality of parallel spaced apart second rod members 52 transversely disposed and attached to the first rod members 50. In the illustrated embodiment, the first rod members are also attached to the intermediate wall structure 24. Further, as illustrated, the first rod members 50 are attached to the beam members 42 of the side wall structures and the beam members 46 of the intermediate wall structure. Both the first and second rod members 42 and 46, respectively, are fabricated of aluminum and may be conveniently attached to the wall structures and each other by, for example, welding.

The container 10 further comprises releasable stop means, such as movable rollers 54, for selectively preventing or allowing movement of barrels along the base structure 14 from a position adjacent the frame structure 12 toward the open front 18 of the container. The stop means 54 extend a predetermined distance into the space between the base structure 14 and shelf structure 20 immediately there-above to selectively abut the cylindrical side wall of the barrels supported on the base structure in a position near the frame structure 12. As illustrated, the rollers 54 are rotatably mounted to a U-shaped bracket 56 which is attached to the first rod member 50 of the shelf member 20 immediately above the base structure 14. A coil spring 60 is provided to maintain the roller in a downward position. A handle 62 is also provided to pivotally operate the roller. When it is desired to allow a barrel to move along the base structure from a position near the frame structure toward the open front 18 of the container, the rollers 54 are manually rotated by the handle about its pivot point 58 to which it is attached so that it no longer abuts the cylindrical wall of the barrel.

The base structure 14 and shelf structures 20 of the embodiments shown are sized and configured to receive a plurality of barrels in side-by-side relationship and a plurality of beer barrels in end-to-end relationship.

Figure 6:
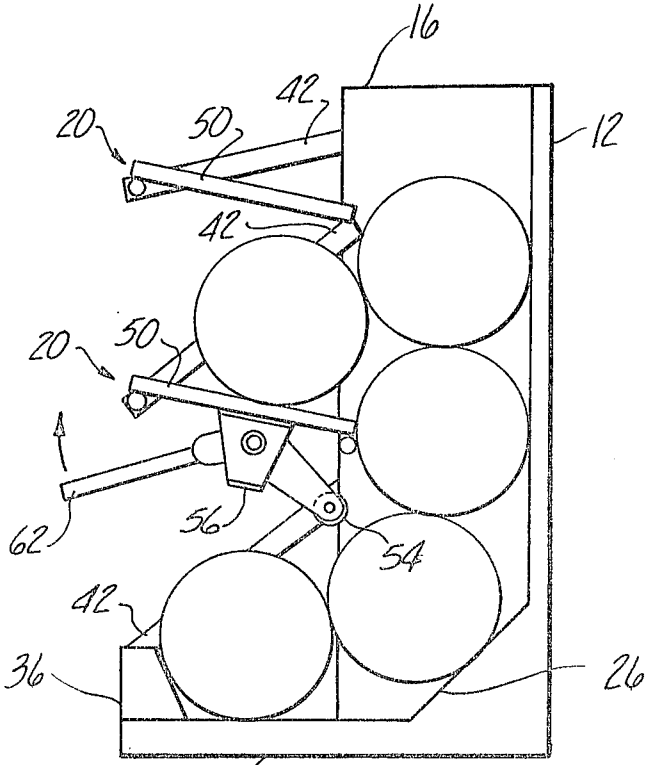
FIG. 6 is a diagrammatic view of the container and cylindrically shaped objects stored on the container when the stop is moved out of position.
Figure 5:
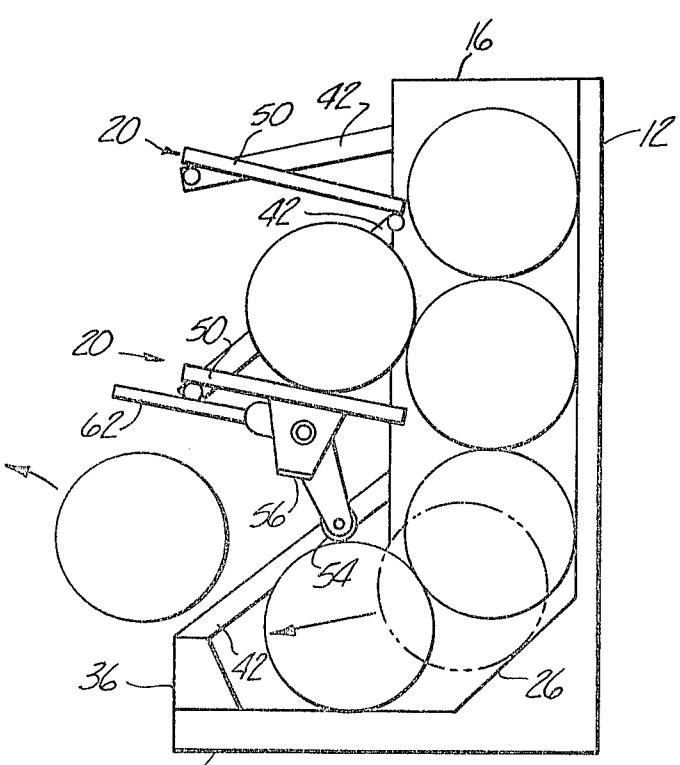
FIG. 5 is a diagrammatic view of the removal of the first cylindrically shaped object from the container and the path established by the remaining cylindrical objects.

FIGS. 5 and 6 show a diagrammatic view of the operation of the container. The container 10 is loaded with a plurality of barrels on the base structure 14 and shelf structures 20 and as the barrels are loaded on the shelves, this space 22 between the terminal edges of the shelf structure 20 and frame structure 12 will fill in. The container thusly loaded with beer barrels may be stored in a warehouse or can be loaded on a truck by a forklift truck and transported to its destination where the barrels are unloaded from the container by simply removing the first barrel resting against the projecting upward flange 36 at the front of the base structure 14. The upwardly projecting flange structure 36 prevents the barrel on the base structure 14 from inadvertently rolling off the base structure through the open front of the rack. The stop means 54 will prevent the barrel located near the frame structure from rolling towards the open front 18 of the container while the front barrel at the open front of the container is removed, thus, preventing injury to a person manually unloading the container. To advance the next barrel located on the base structure 14, the releasable stop means 54 is moved out of abutment with the barrel and permits the next barrel to roll towards the open front 18 of the rack under the influence of the weight of the barrels disposed above it in the space between the terminal edges of the shelf structure 20 and the frame structure 12. The beer barrels supported on the platform shelf structures 20 will, under the influence of gravitational force, roll down their respective shelf structures and, as the supply of beer barrels in the space between the terminal edges of the shelf structures and frame structure is depleted, move downwardly through this space in single file to the base structure 14. The guide ramp structure 26 is located so as to, at all times, maintain a force on the barrel located on the base structure which will enable the barrel on the base structure to be rolled forward towards the upwardly projecting flange structure after the pivoted stop is rotated. When the last full barrel is moved in a position as shown in FIG. 5, it is intended that empty barrels which are collected at the delivery points be loaded upon the container and provide a sufficient force to move the final full barrel into a position against the projected flange structure 36 to enable the unloading of the final full barrel. The container then serves as a storage rack for empty beer barrels which can be returned to the warehouse and subsequently to the brewery.

While the preferred embodiment of the invention has been disclosed, it will be apparent to those skilled in the art that changes may be made to the invention as set forth in the independent claims and in some instances, certain features of the invention may be used to advantage without corresponding use of other features. Accordingly, it is intended that the illustrated and descriptive material herein be used to illustrate the principles of the invention and not to limit the scope thereof.

Having described the invention, what is claimed is:

1. A container for a plurality of cylindrical objects comprising:

a base;

an upright frame structure mounted to said base for cooperation therewith;

means for mounting said upright frame structure to said base;

gravity feed means mounted to said base and to said upright frame structure in a predetermined spaced relationship such that when said cylindrical objects are placed upon said gravity feed means, said cylindrical objects are first moved towards said frame structure, thence along said frame structure towards said base as a result of gravitational force;

means for stopping said cylindrical object mounted to said gravity feed means, said stop means stopping said cylindrical objects at a predetermined distance from said upright frame structure, said means for stopping further comprising a hand operated releasable stop means mounted to said gravity feed means for selectively preventing and allowing movement of the cylindrically shaped objects along said base in a direction away from said upright frame structure, such that, when said plurality of cylindrical shaped objects are placed on their cylindrical side upon said gravity feed means, the force on each cylindrical object causes a first cylindrical object to move along said gravity feed means towards said upright frame structure, thence move downwardly adjacent said upright frame structure toward said base, thence move along said base toward said hand operated releasable stop means, each of said plurality of cylindrical objects following said path defined by said first cylindrical object to form a contiguous array of cylndrical objects along said path, such that when said hand operated releasable stop means is actuated, said first cylindrical object moves along said base past said hand operated releasable stop means to a predetermined position away from said upright frame structure;

means for mounting said gravity feed means to said base and upright frame structure; and means for mounting said stop means to said gravity feed means.

2. The container as claimed in claim 1 wherein, said dispensing means further comprises:

loading means mounted to said frame, said structure loading means and said dispensing means being formed on the same side of said container.

3. A container for shipping, transporting and dispensing a plurality of cylindrically shaped objects, such as beer barrels, said container comprising:

a frame structure comprising:

a base structure for supporting at least one cylindrically shaped beer barrel laid on its side to rest on its cylindrical wall;

two spaced apart side wall structures, one of said wall structures being attached at one side of said base, and the other of said wall structures being attached at the other side of said base, said side wall structures projected from said base in an upright direction;

a rear wall structure attached to said base and said side wall structures to form an upright container having an open front side to permit access to the cylindrically shaped beer barrels in the container;

at least one platform shelf structure mounted to said two spaced apart side wall structures for supporting at least one cylindrically shaped beer barrel laid on its side to rest on its cylindrical wall, said at least one platform member further being spaced above said base structure at a predetermined distance and sloping downwardly from said open front side of said container toward said rear wall structure and terminating short of said frame structure by a predetermined distance somewhat greater than the diameter of the cylindrically shaped beer barrel to form an opening through which said cylindrically shaped beer barrels can pass when laid on their cylindrical side, so that gravitational force on the cylindrically shaped beer barrels resting on said shelf structure will cause said cylindrical beer barrels to roll unrestricted along said shelf structure toward said rear wall structure, and move downwardly unrestricted through said opening between said at least one platform shelf structure and said rear wall structure to said base structure; and hand operated releasable stop means pivotally mounted to said at least one platform shelf structure between said base structure and said at least one platform shelf structure for selectively maintaining connection with and allowing advancing movement of said cylindrically shaped beer barrels along said base structure from a position near said rear wall structure of said container toward said open front side of said container, said releasable stop means selectively maintaining connection with said cylindrical beer barrels only when said one of said plurality of beer barrels rolling past said releasable stop means has been removed from said frame structure so that when said releasable stop means is pivoted to permit advancement of one of said plurality of beer barrels along said base structure towards another open front side of the frame structure, said one of said plurality of beer barrels advances past said releasable stop means to the front of said base structure to abut therewith and thereby form a contiguous array of beer barrels along said base; rear wall and at least one platform shelf structure so that when said one of said plurality of cylindrically shaped beer barrels is removed from said container through said open front side of said container, the remaining beer barrels in said container advance towards said releasable stop means to contact said releasable stop means and maintain connection therewith until said releasable stop means are again pivotably rotated.

4. The container defined in claim 3, further comprising a guide ramp structure mounted to said rear wall structure and to said base structure for smoothly guiding the cylindrically shaped beer barrels onto said base structure from the opening between the shelf structure and said rear wall structure.

5. The container defined in claim 3, wherein said base structure is sized and configured to support a plurality of cylindrically shaped beer barrels in side-by-side relationship and in end-to-end relationship; and said at least one platform shelf structure is sized and configured to support a plurality of cylindrically shaped beer barrels in side-by-side relationship and in end-to-end relationship.

6. The container defined in claim 3, wherein said base structure comprises an upwardly projecting flange structure disposed at the front edge of said base structure to prevent the cylindrically shaped beer barrels supported on said base structure from inadvertently rolling off said base structure.

7. The container defined in claim 3, wherein said releasable stop means comprises at least one movable projection extending a predetermined distance into the space between said base structure and said at least one platform shelf structure to selectively abut the cylindrical wall of said cylindrically shaped beer barrels supported on said base structure said releasable stop means further interposed said frame structure and said upwardly projecting flange structure.

8. The container defined in claim 3, wherein said base structure further comprises means for receiving the lifting forks of a fork lift truck.

9. The container defined in claim 3, wherein said shelf structure comprises:

a plurality of parallel spaced-apart first rod members longitudinally extending between said side wall structures of said container and attached thereto; and a plurality of parallel spaced apart second rod members transversely disposed and attached to said first rod members.

10. The container defined in claim 3, wherein each said side wall structure comprises a structural network of beam members attached to and extending from said rear wall structure toward said open front side of said container.

11. The container defined in claim 10, wherein each of said side wall structure further comprises at least one panel disposed adjacent said rear wall structure and at least partially covering the open areas defined by said network of beam members.

12. The container defined in claim 3, further comprising at least one intermediate wall structure disposed between said two side wall structures and spaced from said side wall structures by a distance somewhat greater than the axial length of the cylindrically shaped beer barrels to be placed in said container.

13. The container defined in claim 12, wherein said intermediate wall structure comprises a structural network of beam members attached to and extending from said back wall structure toward said open front side of said container.

14. The container defined in claim 13, wherein said intermediate wall structure further comprises at least one panel disposed adjacent said rear wall structure and at least partially covering the open areas defined by said network of beam members.

15. A container for transporting, shipping and dispensing a plurality of cylindrical objects such as beer barrels, said container comprising:

a base structure;

an upright frame structure mounted to said base structure for cooperation therewith, said frame structure comprising:

a rear wall member;

two spaced apart side wall members attached to said base and said rear wall member to form a container having an open front side and top side for receiving said beer barrels;

means for mounting said rear wall member and said two side wall members to said base structure;

a first platform member interposed said two side wall members and mounted a predetermined distance above said base structure, said first platform member further being disposed sloping downwardly from said front open side of said container towards said rear wall and at a predetermined distance from said rear wall member, such that, when one of said plurality of cylindrical beer barrels is placed on its cylindrical side upon said first platform member, gravitational force on said cylindrical beer barrel causes said one cylindrical beer barrel to roll unrestricted along a first continuous path towards said rear wall member of the upright frame structure along said sloping downwardly first platform member through said predetermined distance between said rear wall and said first platform member and downwards along said rear wall towards said base structure, each of said plurality of cylindrical beer barrels following said first continuous path defined by said one cylindrical beer barrel to form a contiguous array of cylindrical beer barrels along said first path;

a guide ramp member mounted to said base and upright frame structure underneath said predetermined distance between said rear wall member and said first platform member for receiving said cylindrical beer barrels as they move unrestricted along said first continuous path towards said base structure and further for guiding said cylindrical beer barrels along a second path along said guide member and base structure towards said open front side of said upright frame structure;

a first stop member mounted to said base structure for stopping said cylindrical beer barrels at a predetermined distance from said guide ramp member;

at least one movable second stop member pivotally mounted to said first platform member for selectively stopping said beer barrels along said second path, said at least one second stop member communicating with said cylindrical beer barrels to selectively stop said cylindrical beer barrels in a predetermined position from said open front side when said at least one movable second stop member is in a first closed position, said second stop member selectively maintaining connection with said cylindrical beer barrels only when said one of said plurality of beer barrels rolling past said second stop member has been removed from said upright frame structure so that when said second stop member is pivoted to permit advancement of another one of said plurality of beer barrels along said base structure towards said open front side of the frame structure, said another one of said plurality of beer barrels advances past said second stop member to the front of said base structure to abut said first stop member and thereby form a contiguous array of beer barrels along said base, rear wall, and at least one platform shelf structure, so that, when said one of said plurality of cylindrically shaped beer barrels is removed from said container through said open front side of said container, the remaining beer barrels in said container advance towards said second stop member to contact said second stop member and maintain connection therewith until said second stop member is again pivotably rotated;

at least one additional platform member mounted a predetermined distance above said first platform member to said upright frame structure, said at least one additional platform member further being disposed sloping downwardly from said open front side of said container and at a predetermined distance from said rear wall member, such that, when one of said plurality of cylindrical beer barrels is placed on its cylindrical side upon said at least one additional platform member, the gravitational force on said one cylindrical beer barrel causes said one cylindrical beer barrel to roll unrestricted along a third path towards said rear wall member of the upright frame structure along said sloping downwardly at least one additional platform member through said predetermined distance between said rear wall and said at least one additional platform member and downwards, along said rear wall towards said guide ramp member to a predetermined distance intersecting said first path then along said first and second path to said first stop member when said at least one movable second stop member is in a second open position, each of said plurality of cylindrical beer barrels following said third path defined by said one of said plurality of cylindrical beer barrels to form a contiguous array of unrestricted cylindrical beer barrels along said path, such that when said container is loaded with said cylindrical beer barrels to form a contiguous array of beer barrels along said first, second and third paths and said at least one movable stop member is pivoted to said second open position, said one of said plurality of beer barrels contacting said at least one movable second stop member is forced to roll towards said first stop member by the force of all of the plurality of beer barrels remaining in said container such that said plurality of cylindrical beer barrels stored on the container move unrestricted and in continuous contact towards said second path along said first continuous path of the first platform member or along said first path to said predetermined distance intersecting said third path thence along said their path of said at least one additional platform member.

* * * * *